US011852132B2

(12) United States Patent
Liu et al.

(10) Patent No.: US 11,852,132 B2
(45) Date of Patent: Dec. 26, 2023

(54) COMPRESSOR CYLINDER SWITCHING CONTROL METHOD AND DEVICE, UNIT AND AIR CONDITIONING SYSTEM

(71) Applicant: Gree Electric Appliances, Inc. of Zhuhai, Guangdong (CN)

(72) Inventors: Hua Liu, Guangdong (CN); Ke Xu, Guangdong (CN); Qunbo Liu, Guangdong (CN); Longfei Li, Guangdong (CN); Yaopeng Rong, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 468 days.

(21) Appl. No.: 17/259,578

(22) PCT Filed: Dec. 19, 2018

(86) PCT No.: PCT/CN2018/121884

§ 371 (c)(1),
(2) Date: Jan. 12, 2021

(87) PCT Pub. No.: WO2020/034516

PCT Pub. Date: Feb. 20, 2020

(65) Prior Publication Data

US 2021/0270260 A1 Sep. 2, 2021

(30) Foreign Application Priority Data

Aug. 17, 2018 (CN) ..... 201810941575.1

(51) Int. Cl.
*F04B 49/06* (2006.01)
*F04B 27/00* (2006.01)
(Continued)

(52) U.S. Cl.
CPC ..... *F04B 49/065* (2013.01); *F04B 27/005* (2013.01); *F04B 49/02* (2013.01);
(Continued)

(58) Field of Classification Search
CPC ..... F04B 49/065; F04B 49/02; F04B 27/005; F04B 2205/07; F04B 2207/03;
(Continued)

(56) References Cited

U.S. PATENT DOCUMENTS 4,407,139 A * 10/1983 Ide ..... G05D 23/20 62/215
4,485,634 A * 12/1984 Yasuda ..... F04C 28/02 62/196.2

(Continued)

FOREIGN PATENT DOCUMENTS

CN 103884081 A 6/2014
CN 104047843 A 9/2014

(Continued)

*Primary Examiner* — Christopher S Bobish
(74) *Attorney, Agent, or Firm* — The Webb Law Firm

(57) ABSTRACT

The disclosure discloses a method and a device for controlling cylinder switching of a compressor, a unit and an air conditioning system. The method includes: determining whether the compressor needs to perform cylinder switching; if so, adjusting current operating frequency according to a system pressure difference so that both the adjusted operating frequency and the system pressure difference meet a cylinder switching condition of the compressor; and controlling the compressor to perform cylinder switching. At the moment, the system pressure difference and the operation frequency are stable, and would not interfere the compressor's maintaining of the single-cylinder or double-cylinder operation state, which guarantees the energy efficiency of the unit where the compressor is located, and improves the use experience of a user.

20 Claims, 4 Drawing Sheets

(51) Int. Cl.

| | |
|---|---|
| ***F04B 49/02*** | (2006.01) |
| ***F04C 23/00*** | (2006.01) |
| ***F04C 28/08*** | (2006.01) |
| ***F04C 28/02*** | (2006.01) |

(52) U.S. Cl.
CPC ..... *F04C 23/001* (2013.01); *F04C 28/02* (2013.01); *F04C 28/08* (2013.01); *F04B 2203/0204* (2013.01); *F04B 2205/07* (2013.01); *F04B 2207/03* (2013.01); *F04B 2207/703* (2013.01); *F04C 2270/075* (2013.01); *F04C 2270/095* (2013.01)

(58) Field of Classification Search
CPC ..... F04B 2203/0204; F04C 23/001; F04C 28/02; F04C 28/08; F04C 2270/075; F04C 2270/095
See application file for complete search history.

(56) References Cited

U.S. PATENT DOCUMENTS

| | | | | | |
|---|---|---|---|---|---|
| 4,502,842 | A * | 3/1985 | Currier | F04B 49/065 | 417/63 |
| 5,013,217 | A * | 5/1991 | Hitosugi | F25B 1/04 | 417/45 |
| 5,050,233 | A * | 9/1991 | Hitosugi | F04C 28/02 | 417/427 |
| 5,094,085 | A * | 3/1992 | Irino | F25B 49/022 | 62/196.2 |
| 5,170,636 | A * | 12/1992 | Hitosugi | F25B 49/022 | 236/1 EA |
| 5,600,961 | A * | 2/1997 | Whipple, III | F25B 49/022 | 62/175 |
| 7,585,163 | B2 * | 9/2009 | Nishikawa | F01C 21/0863 | 418/24 |
| 10,473,367 | B2 * | 11/2019 | Yokoyama | F25B 30/02 | |
| 2006/0008360 | A1 * | 1/2006 | Nishikawa | F01C 21/0863 | 417/244 |
| 2006/0204368 | A1 | 9/2006 | Imai et al. | | |
| 2016/0084546 | A1 * | 3/2016 | Yokoyama | F04C 28/065 | 417/5 |
| 2020/0232464 | A1 | 7/2020 | Hu et al. | | |

FOREIGN PATENT DOCUMENTS

| | | | |
|---|---|---|---|
| CN | 203823994 | U | 9/2014 |
| CN | 104728109 | A | 6/2015 |
| CN | 104729138 | A | 6/2015 |
| CN | 106642777 | A | 5/2017 |
| CN | 206959382 | U | 2/2018 |
| CN | 107860161 | A | 3/2018 |
| CN | 107917078 | A | 4/2018 |
| CN | 108800481 | A | 11/2018 |
| EP | 1700725 | A1 | 9/2006 |
| EP | 2629025 | A1 | 8/2013 |
| EP | 3779301 | A1 | 2/2021 |
| WO | 2015162780 | A1 | 10/2015 |
| WO | 2016112441 | A1 | 7/2016 |

* cited by examiner

COMPRESSOR CYLINDER SWITCHING CONTROL METHOD AND DEVICE, UNIT AND AIR CONDITIONING SYSTEM

CROSS-REFERENCE TO RELATED APPLICATIONS

The present disclosure is the United States national phase of International Application No. PCT/CN2018/121884 filed Dec. 19, 2018, and claims the priority of the Chinese patent application entitled "COMPRESSOR CYLINDER SWITCHING CONTROL METHOD AND DEVICE, UNIT AND AIR CONDITIONING SYSTEM" filed on Aug. 17, 2018 and having application number 201810941575.1, the disclosures of which are incorporated herein by reference in their entirety.

BACKGROUND

Field of the Invention

The disclosure relates to the technical field of units, in particular to a method and a device for controlling cylinder switching of a compressor, a unit and an air conditioning system.

Description of Related Art

At present, in order to solve the problems of low load and poor energy efficiency of multi-split units, a single-cylinder and double-cylinder switching technology of a compressor is developed. In the single-cylinder and double-cylinder switching technology, certain working parameters (such as system pressure difference) of a compressor are key factors influencing normal cylinder switching of the compressor. And in the actual operation of a unit, a fan, an electronic expansion valve, different working conditions and other factors can cause fluctuation of the system pressure difference, so that normal cylinder switching of the compressor is influenced. For example: when the unit is in an ultralow temperature heating starting stage (the ambient temperature is extremely low), the system pressure difference is small and its rising speed is slow, so the system pressure difference value required by the double-cylinder operation of the compressor cannot be reached in a short time, so that the compressor cannot be normally switched to the double-cylinder operation, and the probability of cylinder switching failure is increased. And the operating frequency also affects the normal cylinder switching of the compressor. For example, if the cylinder switching of the compressor is performed when the operation frequency is high, the system pressure is suddenly fluctuated due to the change of the volume of the cylinder body, and the abnormal protection of the system pressure is triggered. The two kinds of circumstances mentioned above may both cause the compressor unable to switch the cylinder normally, which reduces the reliability of cylinder switching and the energy efficiency of the unit, and affects user experience.

SUMMARY OF THE INVENTION

The embodiments of the disclosure provide a method and device for controlling cylinder switching of a compressor, a unit and an air conditioning system to solve the problem of high failure rate of compressor cylinder switching in the related arts.

In order to solve the above technical problem, in a first aspect, the present disclosure provides a method for controlling cylinder switching of a compressor, wherein the method includes:

determining whether the compressor needs to perform cylinder switching;

if so, adjusting current operating frequency according to a system pressure difference so that both the adjusted operating frequency and the system pressure difference meet a cylinder switching condition of the compressor; and controlling the compressor to perform cylinder switching.

Further, the adjusting current operating frequency according to a system pressure difference includes:

determining target operating frequency according to the system pressure difference; and adjusting the current operating frequency to the target operating frequency.

Further, the determining whether the compressor needs to perform cylinder switching includes:

determining that the compressor needs to be switched from single-cylinder operation to double-cylinder operation; and the determining target operating frequency according to the system pressure difference includes:

if Pc−Pe>b, determining the target operating frequency f=c; or if Pc−Pe∈[a, b], determining the target operating frequency f according to the current operating frequency F, including:

if F>c, determining f=c; or if F<c−k, determining f=c−k; or if F∈[c−k, c], determining f=F; or if Pc−Pe<a, determining the target operating frequency f as a highest frequency threshold of the compressor;

wherein Pc is a system high pressure, Pe is a system low pressure, Pc−Pe is the system pressure difference, F is the current operating frequency of the compressor, f is the target operating frequency of the compressor, and a, b, c and k are preset values.

Further, if Pc−Pe<a, the determining the target operating frequency f as a highest frequency threshold of the compressor includes:

during frequency raising period of adjusting the current operating frequency to the target operating frequency, continuously determining whether Pc−Pe>b or whether Pc−Pe∈[a, b].

Further, if it is determined that the compressor needs to be switched from single-cylinder operation to double-cylinder operation, the cylinder switching condition includes:

$$Pc-Pe\in[a,b] \text{ and } F\in[c-k,c].$$

Further, the determining whether the compressor needs to perform cylinder switching includes:

determining that the compressor needs to be switched from the double-cylinder operation to the single-cylinder operation; and the determining target operating frequency according to the system pressure difference includes:

if Pc−Pe>d, determining the target operating frequency f=e; or if Pc−Pe≤d, determining the target operation frequency f according to the current operation frequency F;

if Pc−Pe≤d, determining the target operating frequency f according to the current operating frequency F, including:

if F>e, determining f=e; or if F<e−p, determining f=e−p; or if F∈[e−p, e], determining f=F;

wherein Pc is a system high pressure, Pe is a system low pressure, Pc−Pe is the system pressure difference, F is the current operating frequency of the compressor, f is the target operating frequency of the compressor, and d, e and p are preset values.

Further, if it is determined that the compressor needs to be switched from double-cylinder operation to single-cylinder operation, the cylinder switching condition includes:

$$Pc-Pe \leq d \text{ and } F \in [e-p, e].$$

Further, the controlling the compressor to perform cylinder switching includes:

keeping the target operation frequency unchanged in the process of controlling the compressor to perform cylinder switching.

Further, the method further includes:

determining whether the cylinder of the compressor is successfully switched or not after controlling the compressor to perform cylinder switching; and if not, controlling a unit where the compressor is located to stop, and reporting the cylinder switching fault.

Further, the determining whether the compressor needs to perform cylinder switching includes:

determining that the compressor needs to be switched from the single-cylinder operation to the double-cylinder operation if currently required operating frequency of the compressor is greater than the maximum frequency threshold which is reachable for the compressor in the single-cylinder operation;

wherein the currently required operating frequency of the compressor is determined based on at least one of: a difference value between a setting temperature value and an ambient temperature value, a setting gear of a fan, or a capacity of an internal machine at the tail end of a unit where the compressor is located.

Further, determining whether the compressor needs to perform cylinder switching includes:

determining that the compressor needs to be switched from the double-cylinder operation to the single-cylinder operation if currently required operating frequency of the compressor is less than or equal to a maximum frequency threshold value which is reachable for the compressor in the single-cylinder operation;

wherein the currently required operating frequency of the compressor is determined based on at least one of: a difference value between a setting temperature value and an ambient temperature value, a setting gear of a fan, or a capacity of an internal machine at the tail end of a unit where the compressor is located.

Further, the controlling the compressor to perform cylinder switching includes:

when the compressor is switched from the single-cylinder operation to the double-cylinder operation, controlling a first electromagnetic valve to be powered up, and controlling a second electromagnetic valve to be powered down, so that a variable volume port of the compressor is in a high-pressure state;

when the compressor is switched from the double-cylinder operation to the single-cylinder operation, controlling the first electromagnetic valve to be powered down, and controlling the second electromagnetic valve to be powered up, so that the variable volume port of the compressor is in a low-pressure state;

wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

In a second aspect, some embodiments of the present disclosure provides an air conditioning unit used for performing the method of the first aspect, and the unit includes: a main controller, a compressor and a driving controller of the compressor;

the main controller is used for determining whether the compressor needs to perform cylinder switching; if so, controlling the driving controller to adjust current operating frequency according to a system pressure difference so that both the adjusted operating frequency and the system pressure difference meet a cylinder switching condition of the compressor; and sending a cylinder switching command to the driving controller;

the driving controller is respectively connected with the main controller and the compressor, and is used for controlling the compressor to perform cylinder switching according to the cylinder switching command.

Further, the unit further includes: a high pressure sensor and a low pressure sensor respectively connected with the compressor, wherein the high-pressure sensor is used for detecting the high pressure of the system; the low pressure sensor is used for detecting the low pressure of the system; and the system pressure difference is the difference between the system high pressure and the system low pressure.

Further, the main controller is also used for determining target operation frequency according to the system pressure difference; and sending an operating frequency adjustment instruction to the driving controller; and the driving controller is used for adjusting the current operating frequency of the compressor to the target operating frequency according to the operating frequency adjusting command.

Further, the driving controller is further used to determine whether the cylinder of the compressor is successfully switched after controlling the compressor to switch the cylinder; if not, feeding back cylinder switching failure information to the main controller; the main controller is also used for controlling the unit to stop according to the cylinder switching failure information and reporting the cylinder switching failure.

Further, the main controller is further used for determining that the compressor needs to be switched from single-cylinder operation to double-cylinder operation if currently required operation frequency of the compressor is greater than a maximum frequency threshold value which is reachable for the compressor in the single-cylinder operation; and determining that the compressor needs to be switched from the double-cylinder operation to the single-cylinder operation if the currently required operating frequency of the compressor is less than or equal to the maximum frequency threshold value;

wherein the currently required operating frequency of the compressor is determined based on at least one of: a difference value between a setting temperature value and an ambient temperature value, a setting gear of a fan, or a capacity of an internal machine at the tail end of the unit.

Further, the main controller is connected with a first electromagnetic valve and a second electromagnetic valve, respectively, and is further used for controlling the first electromagnetic valve to be powered up and the second electromagnetic valve to be powered down when the compressor is switched from the single-cylinder operation to the double-cylinder operation, so that a variable volume port of the compressor is in a high-pressure state; and controlling the first electromagnetic valve to be powered down and the second electromagnetic valve to be powered up when the compressor is switched from the double-cylinder operation to the single-cylinder operation, so that the variable volume port of the compressor is in a low-pressure state;

wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

In a third aspect, some embodiments of the present disclosure provides a device for controlling cylinder switching of a compressor, the device being used to perform the method of the second aspect, the device including:

a determining module used for determining whether the compressor needs to perform cylinder switching;

an adjusting module used for adjusting current operating frequency according to a system pressure difference if the compressor needs to perform cylinder switching so that both the adjusted operating frequency and the system pressure difference meet a cylinder switching condition of the compressor; and a control module used for controlling the compressor to perform cylinder switching.

Further, the adjusting module is used for determining target operating frequency according to the system pressure difference; adjusting the current operating frequency to the target operating frequency.

Further, the device further includes: a determining module used for determining whether the cylinder of the compressor is successfully switched or not after the cylinder of the compressor is switched; if not, controlling the unit where the compressor is located to stop, and reporting the cylinder switching fault.

Further, the determining module is further configured to determine that the compressor needs to be switched from single-cylinder operation to double-cylinder operation if the currently required operating frequency of the compressor is greater than a maximum frequency threshold which is reachable for the compressor operates in single-cylinder operation;

if the currently required operating frequency of the compressor is less than or equal to the maximum frequency threshold value, determining that the compressor needs to be switched from double-cylinder operation to single-cylinder operation;

wherein the currently required operating frequency of the compressor can be determined based on at least one of the following three factors: a difference value between a setting temperature value and an ambient temperature value, a setting gear of a fan, or a capacity of an internal machine at the tail end of the unit where the compressor is located.

Further, the control module is further used for controlling the first electromagnetic valve to be powered up and the second electromagnetic valve to be powered down when the compressor is switched from the single-cylinder operation to the double-cylinder operation, so that a variable volume port of the compressor is in a high-pressure state; and controlling the first electromagnetic valve to be powered down and the second electromagnetic valve to be powered up when the compressor is switched from the double-cylinder operation to the single-cylinder operation, so that the variable volume port of the compressor is in a low-pressure state;

wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

In a fourth aspect, some embodiments of the present disclosure further provides an air conditioning system, which includes the unit described in the second aspect.

Further, the air conditioning system is a variable frequency and variable capacity air conditioning system.

When the technical solution of the present disclosure is applied, firstly, determine whether the compressor needs to switch the cylinder; if so, adjust the current operating frequency according to the system pressure difference so as to control the cylinder switching of the compressor after both the adjusted operating frequency and the system pressure difference meet the cylinder switching condition of the compressor. Therefore, two factors influencing cylinder switching of the compressor, namely, the system pressure difference and the current operating frequency, can be adjusted firstly, so that the cylinder switching of the compressor is controlled after both the system pressure difference and the current operating frequency meet the cylinder switching condition of the compressor. At the moment, the system pressure difference and the operation frequency are stable, the compressor cannot be interfered to maintain a single-cylinder or double-cylinder state any more, the reliable cylinder switching and stable operation of the unit where the compressor is located are guaranteed, the energy efficiency of the unit is indirectly improved, and the use experience of a user is improved.

BRIEF DESCRIPTION OF THE DRAWINGS

In order to more clearly illustrate the embodiments of the present disclosure or the technical solutions in the prior art, the drawings used in the embodiments or the related arts descriptions will be briefly described below. It is obvious that the drawings in the following description are only the embodiments of the present disclosure, and other drawings can be obtained by those skilled in the art without creative efforts based on the disclosed drawings.

DETAILED DESCRIPTION OF THE INVENTION

The present disclosure is described in further detail below with reference to the attached drawings and specific embodiments, and it should be understood that the specific embodiments described herein are merely illustrative of the present disclosure and are not intended to limit the present disclosure.

In the following description, suffixes such as "module", "component", or "unit" used to indicate elements are used only for helping the description of the present disclosure, and have no particular meaning in themselves. Thus, "module", "component", or "unit" may be used mixedly.

Figure 1:
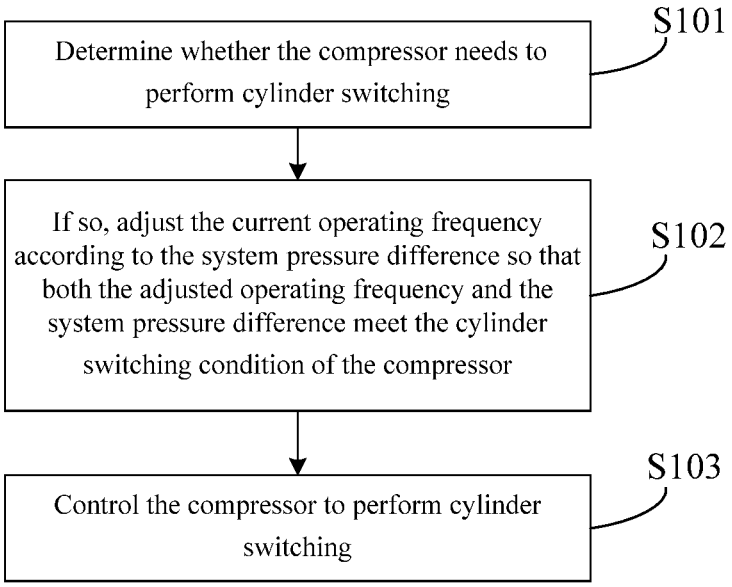
FIG. 1 is a flow chart of a method of controlling compressor cylinder switching according to some embodiments of the present disclosure.

Please refer to FIG. 1, which is a block diagram for solving the problems of low reliability and high failure rate of the cylinder switching of the compressor in the related art. The embodiments of the disclosure provides a method for controlling cylinder switching of a compressor, which includes the following steps:

step S101, whether the compressor needs to perform cylinder switching is determined;

step S102, if so, current operating frequency is adjusted according to a system pressure difference so that both the adjusted operating frequency and the system pressure difference meet the cylinder switching condition of the compressor;

step S103, the compressor is controlled to switch the cylinder.

In the embodiments, firstly, whether the compressor needs to perform cylinder switching is determined; if so, the current operating frequency is adjusted according to the system pressure difference so as to control the cylinder switching of the compressor after both the adjusted operating frequency and the system pressure difference meet the cylinder switching condition of the compressor. Therefore, two factors influencing cylinder switching of the compressor, namely the system pressure difference and the current operating frequency, can be adjusted firstly, so that the cylinder switching of the compressor is controlled after the system pressure difference and the current operating frequency both meet the cylinder switching condition of the compressor. At the moment, the system pressure difference and the operation frequency are stable, and will no longer interfere with the compressor maintaining the single-cylinder or double-cylinder state anymore, so that the reliable cylinder switching and stable operation of a unit where the compressor is located are guaranteed, the energy efficiency of the unit is indirectly improved, and the use experience of a user is improved.

In some embodiments, the step S101 of determining whether the compressor needs to switch the cylinder includes: it is determined that the compressor needs to be switched from single-cylinder operation to double-cylinder operation if current required operating frequency of the compressor is greater than a maximum frequency threshold value which is reachable for the compressor in single-cylinder operation; it is determined that the compressor needs to be switched from double-cylinder operation to single-cylinder operation if currently required operating frequency of the compressor is less than or equal to the maximum frequency threshold value; wherein the currently required operating frequency of the compressor can be determined according to at least one of the following three factors: a difference value between a setting temperature value and an environment temperature value, a setting gear of a fan, or a capacity of an internal machine at the tail end of a unit where the compressor is located.

An air conditioner is taken as an example for explanation. The implementation mode shows that when the requirement of a user on the refrigerating or heating capacity of the air conditioner is so high that the single-cylinder operation of the compressor cannot meet the refrigerating capacity or the heating capacity required by the user, the compressor can operate in double cylinders so as to improve the refrigerating or heating capacity of the air conditioner. In an application example, if the ambient temperature value is minus 30V, when a user needs to start a heating mode of the air conditioner, the temperature value set by the remote controller is 18V, which means that the difference between the set temperature value and the ambient temperature value is large. If the user sets the fan gear to be a strong gear (indicating that the user has a high requirement on the heating capacity of the air conditioner), the unit can determine the required compressor operating frequency according to the logical algorithm relationship between the parameters and the compressor operating frequency, and determine whether the frequency has exceeded a maximum frequency threshold that can be tolerated for single-cylinder operation of the compressor. If so, the double-cylinder operation of the compressor is controlled to meet the use experience of the user. In addition, in the multi-split system, the requirement on the refrigerating or heating capacity of the air conditioner can be improved when the capacity of the internal machine is increased (for example, a user turns on an air conditioner in a living room and then turns on an air conditioner in a bedroom), and the double-cylinder operation of the compressor can be performed when the single-cylinder operation cannot meet the requirement.

For the same reason, if the single-cylinder operation of the compressor is enough to ensure the heating capacity or the refrigerating capacity required by a user at present, the compressor is controlled to be switched from the double-cylinder operation to the single-cylinder operation, so that the user experience is met, the energy is saved, and the idle work is avoided.

Figure 2:
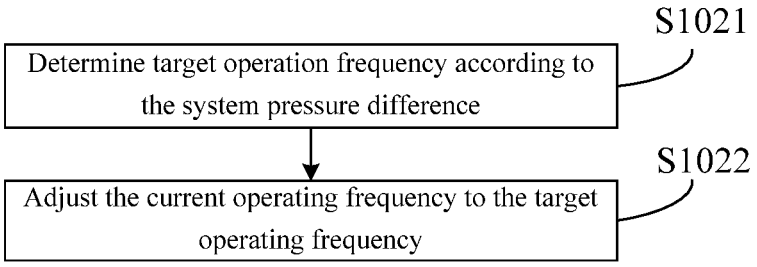
FIG. 2 is a flow chart of a method of controlling compressor cylinder switching according to some other embodiments of the present disclosure.

After the cylinder switching of the compressor is determined, the system pressure difference and the operation frequency can be adjusted in the cylinder switching preparation stage, namely the stage before the cylinder switching is carried out. Based on this, as shown in FIG. 2, the step S102 of adjusting the current operating frequency according to the system pressure difference includes:

step S1021, determining target operation frequency according to the system pressure difference;

step S1022, adjusting the current operating frequency to the target operating frequency.

In some embodiments, if it is determined that the compressor is switched from the single-cylinder operation to the double-cylinder operation, the determining the target operation frequency according to the system pressure difference in step S1021 includes:

if $Pc-Pe>b$, determining the target operating frequency $f=c$; or if $Pc-Pe\in[a, b]$, determining the target operation frequency f according to the current operation frequency F; or if $Pc-Pe<a$, determining the target operating frequency f as a highest frequency threshold of the compressor;

wherein Pc is a system high pressure, Pe is a system low pressure, $Pc-Pe$ is the system pressure difference, F is the current operating frequency of the compressor, f is the target operating frequency of the compressor, and a, b and c are preset values. If $Pc-Pe\in[a, b]$, the determining the target operating frequency f according to the current operating frequency F comprises: if $F>c$, determining $f=c$; or if $F<c-k$, determining $F=c-k$; or if $F\in[c-k, c]$, $f=F$, and k is a preset value.

The following example briefly illustrates the above embodiments. When it is determined that the compressor needs to be switched from single-cylinder operation to double-cylinder operation, it means that the current system pressure difference could reach the system pressure difference that is required to switch the compressor to the double-cylinder operation and maintain double-cylinder operation. However, the system pressure difference should not be too large in order to avoid damage to the compressor or increase the operational burden on the unit. On the other hand, the current operating frequency should also reach the operating frequency required for the compressor to be able to switch to and maintain the double-cylinder operation. Therefore, the conditions that the compressor needs to be switched from single-cylinder operation to double-cylinder operation can be determined as follows: $Pc-Pe \in [a, b]$ and $F \in [c-k, c]$.

The value c is determined according to the performance of the compressor and the ideal working condition when the compressor is in a factory. In practical application, the environment is complex and changeable, and errors maybe exist. In usual circumstances, the compressor can be guaranteed to switch to double-cylinder operation when $F \in [c-k, c]$, but F is not necessarily equal to the value of c. Therefore, the cylinder switching condition is set as $Pc-Pe \in [a, b]$ and $F \in [c-k, c]$, where k may be 10 Hz.

In order to prevent damage to the compressor, the value of c−k should be not lower than a preset proportional value of a highest frequency threshold, and the maximum value of c should not be higher than a preset proportional value of the highest frequency threshold. For example: the value of c−k may be 30% of the highest frequency threshold, and the value of c may be 80% of the highest frequency threshold.

It will be appreciated that the system pressure difference can vary as the current operating frequency varies. And specifically, the system pressure difference increases as the current operating frequency increases.

In the first case, when the system pressure difference is greater than b, it indicates that the system pressure difference is too large. The reason for the excessive system pressure difference may be that the current operating frequency is relatively high. Thus the target operating frequency is set as c, and the actual operating frequency of the compressor is controlled to decrease to c, so that the system pressure difference decreases with the decrease of the frequency, and finally decreases to [a, b].

In the second case, when the system pressure difference belongs to [a, b], it means that the system pressure difference meets the cylinder switching condition, and the actual operation frequency could be adjusted and controlled to meet the cylinder switching condition. At the moment, if the actual operating frequency is greater than c, the actual operating frequency is reduced to be equal to c; if the actual operating frequency is less than c−k, the actual operating frequency is increased to be equal to c−k; and if the actual operating frequency belongs to [c−k, c], it indicates that the actual operating frequency meets the cylinder switching condition and does not need to be adjusted.

In the third case, when the system pressure difference is less than a, it indicates that the system pressure difference does not meet the cylinder switching condition, so the target operation frequency is determined as the highest frequency threshold of the compressor, and the actual operating frequency of the compressor is adjusted until reaching the target operating frequency. In some embodiments, if $Pc-Pe<a$, the determining the target operating frequency f as the highest frequency threshold of the compressor comprises: during frequency raising period of adjusting the current operating frequency to the target operating frequency, continuously determining whether $Pc-Pe>b$ or whether $Pc-Pe \in [a, b]$. That is to say, in the frequency raising process, the value of the system pressure difference may be detected in real time or at different time intervals. If the value of the system pressure difference satisfies the condition shown in the first case or the second case, the target operating frequency is continuously adjusted according to the adjustment manner shown in the first case or the second case, so as to adjust the actual operating frequency, so that the actual operating frequency reaches the target operating frequency. If the actual operating frequency is increased to the highest frequency threshold value, the system pressure difference is still smaller than a, it indicates that the unit breaks down and cannot be switched to double-cylinder operation, so fault alarming can be carried out to prompt a user to maintain the unit.

In some embodiments, when it is determined that the compressor needs to be switched from double-cylinder operation to single-cylinder operation, the determining target operating frequency according to the system pressure difference comprises: if $Pc-Pe>d$, determining the target operating frequency $f=e$; or, if $Pc-Pe \leq d$, determining the target operation frequency f according to the current operating frequency F; wherein Pc is a system high pressure, Pe is a system low pressure, Pc−Pe is the system pressure difference, F is the current operating frequency of the compressor, f is the target operating frequency of the compressor, and d and e are preset values.

If $Pc-Pe \leq d$, the determining the target operation frequency f according to the current operating frequency F comprises:

if $F>e$, determining $f=e$; or if $F<e-p$, determining $f=e-p$; or if $F \in [e-p, e]$, determining $f=F$; wherein p is a preset value. the cylinder switching condition for determining that the compressor needs to be switched to single-cylinder operation from double-cylinder operation is: $Pc-Pe \leq d$ and $F \in [e-p, e]$.

It should be noted that when the compressor needs to be switched from double-cylinder operation to single-cylinder operation, it can be understood that the system pressure difference is reduced, which is not enough to maintain the double-cylinder operation of the compressor. The value e is determined in the factory based on the performance of the compressor and the desired operating conditions. In practical application, the environment is complex and changeable, and errors may exist. In usual circumstances, it is guaranteed that the compressor will switch to single-cylinder operation when $F \in [e-p, e]$, but F is not necessarily equal to the value of e. Therefore, the cylinder switching condition is set as: $Pc-Pe \leq d$ and $F \in [e-p, e]$, where e may be 25 Hz.

The above examples are briefly described below. In the first case, when the system pressure difference is greater than d, it indicates that the system pressure difference is relatively large, and the reason for this may be that the current actual operating frequency of the compressor is relatively large. Thus the target operating frequency may be determined as e, and the actual operating frequency is reduced to be equal to e, so as to ensure that the system pressure difference is not greater than d.

In the second case, when the system pressure difference is less than or equal to d, it indicates that the system pressure difference meets the cylinder switching condition. At this time, the actual operating frequency is adjusted to the frequency meeting the cylinder cutting condition.

Figure 3:
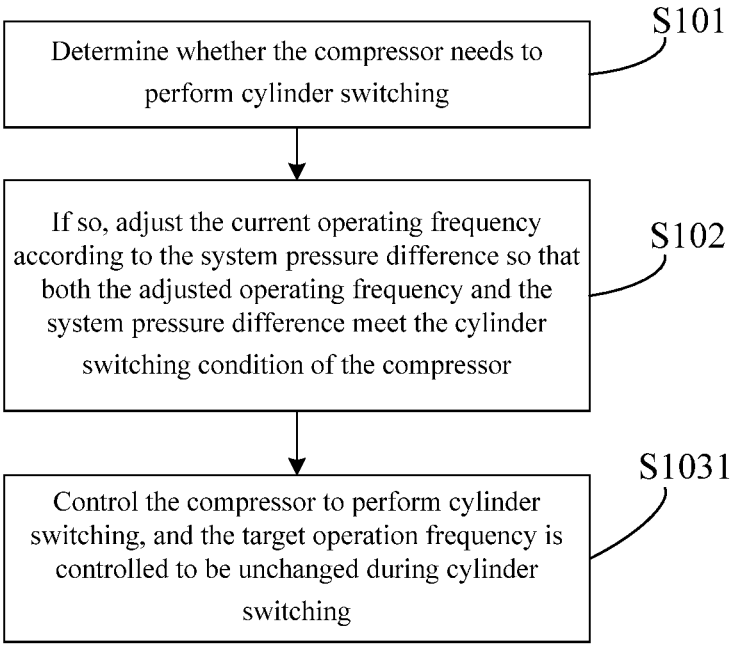
FIG. 3 is a flow chart of a method of controlling compressor cylinder switching according to still some other embodiments of the present disclosure.

In some embodiments, as shown in FIG. 3, the step S103 of controlling the compressor to perform cylinder switching includes: step S1031, keeping the target operation frequency unchanged in the process of controlling the compressor to perform cylinder switching. The value of the target operating frequency should be kept unchanged before the cylinder switching preparation stage is not exited to prevent the cylinder switching from being misjudged due to variation fluctuations of the reference standard.

Figure 4:
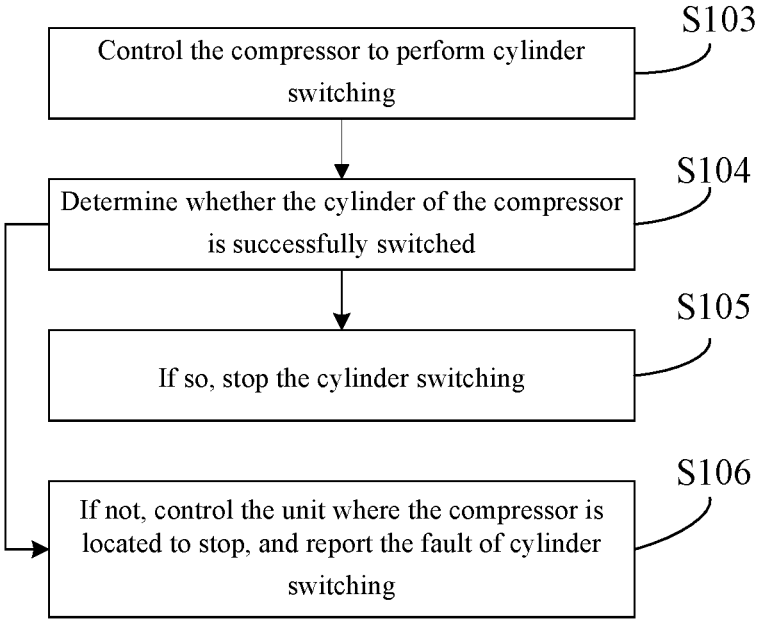
FIG. 4 is a flow chart of a method of controlling compressor cylinder switching according to still some other embodiments of the present disclosure.

In some embodiments, as shown in FIG. 4, after controlling the compressor to perform cylinder switching in step S103, the method further includes:

step S104, determining whether the cylinder of the compressor is successfully switched or not;

step S105, if so, stopping the switching of the cylinder; and step S106, if not, controlling a unit where the compressor is located to stop, and reporting the cylinder switching fault.

In the following, the above implementation manner is described from the perspective of hardware. A main controller sends a cylinder switching command to a driving controller of the compressor, and after receiving the cylinder switching command, the driving controller of the compressor controls the compressor to perform the cylinder switching and determines whether the cylinder of the compressor is successfully switched. If so, the driving controller feeds back cylinder switching success information to the main controller, and the main controller quits the cylinder switching control action after receiving the cylinder switching success information, and the unit stops performing cylinder switching. If not, the driving controller feeds back cylinder switching failure information to the main controller, and the main controller controls the unit to stop and notifies the cylinder switching failure.

In this way, the unit can be maintained timely when a cylinder switching fault occurs, and further damage is avoided.

In some embodiments, the step S103 of controlling the compressor to perform cylinder switching includes: when the compressor is switched from single-cylinder operation to double-cylinder operation, controlling a first electromagnetic valve to be powered up, and controlling a second electromagnetic valve to be powered down, so that a variable volume port of the compressor is in a high-pressure state; when the compressor is switched from double-cylinder operation to single-cylinder operation, controlling the first electromagnetic valve to be powered down, and controlling the second electromagnetic valve to be powered up, so that the variable volume port of the compressor is in a low-pressure state; wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

It is determined that a branch where the first electromagnetic valve is located is in an open circuit state when the first electromagnetic valve is powered down; it is determined that a branch where the first electromagnetic valve is located is a path when the first electromagnetic valve is powered up; it is determined that the branch where the second electromagnetic valve is located is in an open circuit state when the second electromagnetic valve is powered down; and it is determined that the branch where the second electromagnetic valve is located is a path when the second electromagnetic valve is powered up.

The compressor can be controlled to be in a single-cylinder state or a double-cylinder state by powering up or powering down the first electromagnetic valve and the second electromagnetic valve. It will be appreciated that the single and double cylinder compressors are not limited to this configuration.

Figure 5:
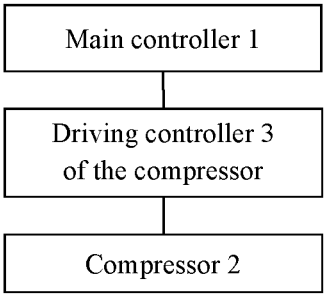
FIG. 5 is a block diagram of the structure of a unit according to some embodiments of the present disclosure.

FIG. 5 shows a unit according to some embodiments of the present disclosure. The unit is configured to perform the method according to the above embodiments. The unit comprises: a main controller 1, a compressor 2 and a driving controller 3 of the compressor 2.

The main controller 1 is used for determining whether the compressor 2 needs to perform cylinder switching; if so, controlling the driving controller 3 to adjust current operating frequency according to a system pressure difference so that both the adjusted operating frequency and the system pressure difference meet a cylinder switching condition of the compressor 2; and sending a cylinder switching command to the driving controller 3.

The driving controller 3 is respectively connected with the main controller 1 and the compressor 2 and is used for controlling the compressor 2 to perform cylinder switching according to the cylinder switching command.

Therefore, two factors influencing cylinder switching of the compressor 2, namely the system pressure difference and the current operating frequency, can be adjusted firstly, so that the cylinder switching of the compressor 2 is controlled after both the system pressure difference and the current operating frequency meet the cylinder switching condition of the compressor 2. By now, the system pressure difference and the operation frequency have been stable, and would not interfere the single-cylinder or double-cylinder state of the compressor 2, the reliable cylinder switching and stable operation of the unit are guaranteed, so that the energy efficiency of the unit is indirectly improved, and the use experience of a user is improved.

Figure 6:
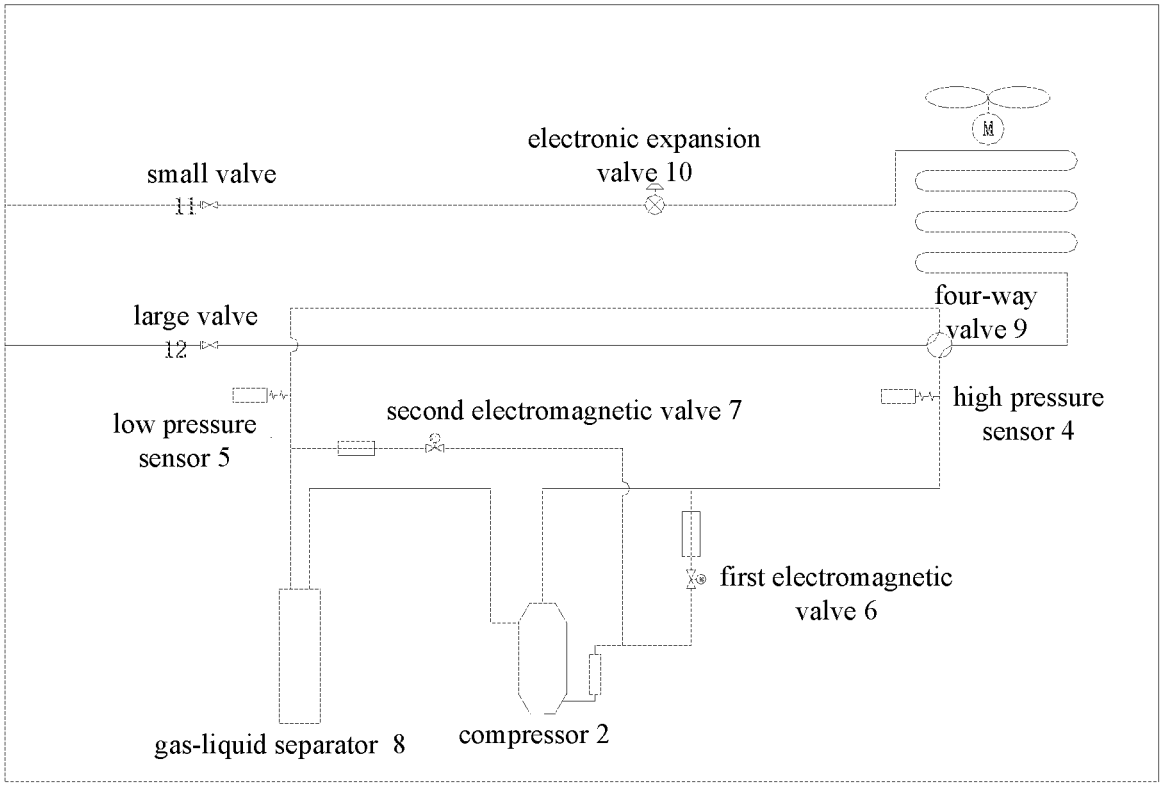
FIG. 6 is a schematic illustration of the structure of a unit according to some other embodiments of the present disclosure.

In some embodiments, as shown in FIG. 6, the unit further includes: a high-pressure sensor 4 and a low-pressure sensor 5, which are respectively connected with the compressor 2, wherein the high-pressure sensor 4 is used for detecting system high pressure, and the low pressure sensor 5 is used for detecting system low pressure; the system pressure difference is the difference between the system high pressure and the system low pressure.

In some embodiments, the main controller 1 is further used to determine that the compressor 2 needs to be switched from single-cylinder operation to double-cylinder operation if currently required operation frequency of the compressor is greater than a maximum frequency threshold value which is reachable for the compressor operates in single-cylinder operation; and to determine that the compressor 2 needs to be switched from double-cylinder operation to single-cylinder operation if the currently required operating frequency of the compressor is less than or equal to the maximum frequency threshold value; wherein the currently required operating frequency of the compressor is determined based on at least one of the following three factors: a difference value between a setting temperature value and an ambient temperature value, a setting gear of a fan, or a capacity of an internal machine at the tail end of the unit.

In some embodiments, the main controller 1 is further used to determine target operating frequency according to the system pressure difference; and send an operating frequency adjustment command to the driving controller 3; the driving controller 3 is used for adjusting the current operating frequency of the compressor 2 to the target operating frequency according to the operating frequency adjustment command.

In some embodiments, the driving controller 3 is further used for determining whether the cylinder of the compressor 2 is successfully switched after controlling the compressor to perform cylinder switching; if so, feeding back cylinder switching success information to the main controller 1; if not, feeding back cylinder switching failure information to the main controller 1; the main controller 1 is further used for stopping sending the cylinder switching command according to the cylinder switching success information; and controlling the unit to stop according to the cylinder switching failure information, and reporting the cylinder switching failure.

In some embodiments, the main controller 1 is connected with a first electromagnetic valve 6 and a second electromagnetic valve 7, respectively, and is further used for controlling the first electromagnetic valve 6 to be powered up and the second electromagnetic valve 7 to be powered down when the compressor 2 is switched from single-cylinder operation to double-cylinder operation, so that a variable volume port of the compressor 2 is in a high-pressure state; and controlling the first electromagnetic valve 6 to be powered down and the second electromagnetic valve 7 to be powered up when the compressor 2 is switched from double-cylinder operation to single-cylinder operation, so that the variable volume port of the compressor 2 is in a low-pressure state; the first electromagnetic valve 6 enables an air outlet of the compressor 2 which is in a high-pressure state to be communicated with the variable volume port; and the second electromagnetic valve 7 enables an air suction port of the compressor 2 which is in a low-pressure state to be communicated with the variable volume port.

In some embodiments, the unit further includes: a gas-liquid separator 8, a four-way valve 9, an electronic expansion valve 10, an outdoor fan (upper right corner M in the FIG. 6), a small valve 11 and a large valve 12, wherein the small valve 11 is sequentially connected with the electronic expansion valve 10, the outdoor fan, the four-way valve 9, the high-pressure sensor 4, the compressor 2, the gas-liquid separator 8 and the low-pressure sensor 5, and the low-pressure sensor 5 and the large valve 12 are respectively connected with the four-way valve 9.

Figure 7:
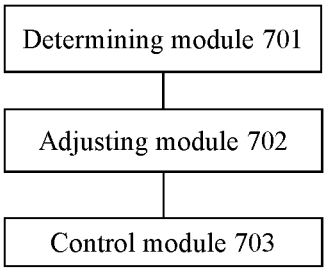
FIG. 7 is a block diagram illustrating a structure of a device for controlling compression cylinder switching according to some embodiments of the present disclosure.

FIG. 7 shows a device for controlling cylinder switching of a compressor according to some embodiments of the present disclosure. The device is used for performing the method shown in the above embodiments, the device including:

- a determining module 701 used for determining whether the compressor needs to perform cylinder switching;
- an adjusting module 702 used for adjusting current operating frequency according to a system pressure difference if the compressor needs to perform cylinder switching so that both the adjusted operating frequency and the system pressure difference meet a cylinder switching condition of the compressor;
- a control module 703 used for controlling the compressor to perform cylinder switching.

Therefore, two factors influencing cylinder switching of the compressor, namely the system pressure difference and the current operating frequency, can be adjusted firstly, so that the cylinder switching of the compressor is controlled after the system pressure difference and the current operating frequency both meet the cylinder switching condition of the compressor. At this moment, the system pressure difference and the operation frequency are stable, which would not interfere the single-cylinder or double-cylinder state of the compressor, and the reliable cylinder switching and stable operation of the unit are guaranteed, the energy efficiency of the unit where the compressor is located is indirectly improved, and the use experience of a user is improved.

In some embodiments, the determining module 701 is further used for determining that the compressor needs to be switched from single-cylinder operation to double-cylinder operation if the current required operating frequency of the compressor is greater than a maximum frequency threshold that is reachable for the compressor operates in single-cylinder operation; if the currently required operating frequency of the compressor is smaller than or equal to the maximum frequency threshold value, determining that the compressor needs to be switched to a single-cylinder operation from the double-cylinder operation; wherein the currently required operating frequency of the compressor can be determined according to at least one of the following three factors: a difference value between a setting temperature value and an ambient temperature value, a setting gear of a fan, or a capacity of an internal machine at the tail end of the unit.

In some embodiments, the adjusting module 702 is used for determining target operating frequency according to a system pressure difference; and adjusting the current operating frequency to the target operating frequency.

In some embodiments, the device further includes: a determining module used for determining whether the cylinder of the compressor is successfully switched or not after the compressor performs cylinder switching; if so, stopping the cylinder switching; if not, controlling the unit where the compressor is located to stop, and notifying the fault of cylinder switching.

In some embodiments, the control module 703 is further used for controlling the first electromagnetic valve to be powered up, and controlling the second electromagnetic valve to be powered down when the compressor is switched from the single-cylinder operation to the double-cylinder operation, so that the variable volume port of the compressor is in a high-pressure state; the first electromagnetic valve is controlled to be powered down, and the second electromagnetic valve is controlled to be powered up when the compressor is switched from the double-cylinder operation to the single-cylinder operation, so that the variable volume port of the compressor is changed into a low-pressure state; the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

The embodiments of the disclosure also provides an air conditioning system which comprises the unit shown in the FIG. 5 or the FIG. 6.

Furthermore, the air conditioning system is a variable frequency and variable capacity air conditioning system, and can also be a multi-split air conditioning system.

It should be noted that, in this document, the terms "comprise", "include" or any other variation thereof are intended to cover a non-exclusive inclusion, such that a process, method, article, or apparatus that comprises a list of elements does not include only those elements but may include other elements not expressly listed or inherent to such process, method, article, or apparatus. Without further limitation, an element identified by the phrase "comprising an . . . " does not exclude the presence of other identical elements in the process, method, article, or apparatus that comprises the element.

The above-mentioned serial numbers of the embodiments of the present disclosure are merely for description, and do not represent the advantages and disadvantages of the embodiments.

Through the description of the foregoing embodiments, it is clear to those skilled in the art that the method of the foregoing embodiments may be implemented by software plus a necessary general hardware platform, and certainly may also be implemented by hardware, but in many cases, the former is a better implementation. Based on such understanding, the technical solutions of the present disclosure or portions thereof that contribute to the related arts may be embodied in the form of a software product, which is stored in a storage medium (such as ROM/RAM, magnetic disk, optical disk) and includes instructions for enabling a mobile terminal (which may be a mobile phone, a computer, a server, an air conditioner, or a network device) to execute the method according to the embodiments of the present disclosure.

While the present embodiments have been described with reference to the accompanying drawings, it is to be understood that the present disclosure is not limited to the above-described embodiments, which are intended to be illustrative rather than restrictive, and that various changes and modifications may be effected therein by one of ordinary skill in the pertinent art without departing from the scope of the present disclosure as defined by the appended claims.

What is claimed is:

1. A method for controlling cylinder switching of a compressor, comprising:

determining whether the compressor needs to perform cylinder switching;

if so, adjusting a current operating frequency according to a system pressure difference so that both the adjusted operating frequency and the system pressure difference meet a cylinder switching condition of the compressor;

controlling the compressor to perform cylinder switching;

wherein, the adjusting a current operating frequency according to a system pressure difference, comprises:

determining a target operating frequency according to the system pressure difference; and adjusting the current operating frequency to the target operating frequency;

wherein, the determining whether the compressor needs to perform cylinder switching comprises:

determining that the compressor needs to be switched from a single-cylinder operation to a double-cylinder operation; and determining the target operating frequency according to the system pressure difference comprises:

if Pc−Pe>b, determining the target operating frequency f=c; or if Pc−Pe∈[a, b], determining the target operating frequency f according to the current operating frequency F, comprising:

if F>c, determining f=c; or if F<c−k, determining f=c−k; or if F∈[c−k, c], determining f=F; or if Pc−Pe<a, determining the target operating frequency f as a highest frequency threshold of the compressor;

wherein Pc is a system high pressure, Pe is a system low pressure, Pc−Pe is the system pressure difference, F is the current operating frequency of the compressor, f is the target operating frequency of the compressor, and a, b, c and k are preset values.

2. The method of claim 1, wherein if Pc−Pe<a, determining the target operating frequency f as a highest frequency threshold of the compressor comprises:

during frequency raising period of adjusting the current operating frequency to the target operating frequency, continuously determining whether Pc−Pe>b or whether Pc−Pe∈[a, b].

3. The method of claim 1, wherein if it is determined that the compressor needs to be switched from the single-cylinder operation to the double-cylinder operation, the cylinder switching condition comprises:

$$Pc-Pe\in[a,b] \text{ and } F\in[c-k,c].$$

4. The method of claim 1, wherein controlling the compressor to perform cylinder switching comprises:

keeping the target operation frequency unchanged in the process of controlling the compressor to perform cylinder switching.

5. The method of claim 1, further comprising:

determining whether the cylinder of the compressor is successfully switched or not after controlling the compressor to perform cylinder switching; and if not, controlling a unit where the compressor is located to stop, and reporting the cylinder switching fault.

6. The method of claim 1, wherein determining whether the compressor needs to perform cylinder switching comprises:

determining that the compressor needs to be switched from the single-cylinder operation to the double-cylinder operation if a currently required operating frequency of the compressor is greater than a maximum frequency threshold which is reachable for the compressor in the single-cylinder operation;

wherein the currently required operating frequency of the compressor is determined based on at least one of: a difference value between a setting temperature value and an ambient temperature value, a setting gear of a fan, or a capacity of an internal machine at the tail end of a unit where the compressor is located.

7. The method of claim 1, wherein controlling the compressor to perform cylinder switching comprises:

when the compressor is switched from a single-cylinder operation to double-cylinder operation, controlling a first electromagnetic valve to be powered up, and controlling a second electromagnetic valve to be powered down, so that a variable volume port of the compressor is in a high-pressure state;

when the compressor is switched from the double-cylinder operation to the single-cylinder operation, controlling the first electromagnetic valve to be powered down, and controlling the second electromagnetic valve to be powered up, so that the variable volume port of the compressor is in a low-pressure state;

wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

8. An air conditioning unit comprising: a main controller, a compressor and a driving controller of the compressor;

the main controller is used for determining whether the compressor needs to perform cylinder switching;

if so, controlling the driving controller to adjust current operating frequency according to a system pressure difference so that both the adjusted operating frequency and the system pressure difference meet a cylinder switching condition of the compressor; and sending a cylinder switching command to the driving controller, the driving controller is respectively connected with the main controller and the compressor, and is used for controlling the compressor to perform cylinder switching according to the cylinder switching command;

wherein the adjusting current operating frequency according to a system pressure difference comprises:

determining target operating frequency according to the system pressure difference; and adjusting the current operating frequency to the target operating frequency;

the determining whether the compressor needs to perform cylinder switching comprises:

determining that the compressor needs to be switched from the double-cylinder operation to the single-cylinder operation; and the determining target operating frequency according to the system pressure difference comprises:

if $Pc-Pe>d$, determining the target operating frequency $f=e$; or if $Pc-Pe\leq d$, determining the target operation frequency f according to the current operation frequency F;

if $Pc-Pe\leq d$, determining the target operating frequency f according to the current operating frequency F, comprising:

if $F>e$, determining $f=e$; or if $F<e-p$, determining $f=e-p$; or if $F\in[e-p, e]$, determining $f=F$, wherein Pc is a system high pressure, Pe is a system low pressure, Pc−Pe is the system pressure difference, F is the current operating frequency of the compressor, f is the target operating frequency of the compressor, and d, e and p are preset values.

9. The unit according to claim 8, wherein:

the driving controller is further used for determining whether the cylinder of the compressor is successfully switched after controlling the compressor to perform cylinder switching;

if not, feeding back cylinder switching failure information to the main controller; and the main controller is further used for controlling the unit to stop according to the cylinder switching failure information and reporting the cylinder switching failure.

10. The unit according to claim 8, wherein:

the main controller is further used for determining that the compressor needs to be switched from a single-cylinder operation to a double-cylinder operation if a currently required operation frequency of the compressor is greater than a maximum frequency threshold value which is reachable for the compressor in the single-cylinder operation; and determining that the compressor needs to be switched from the double-cylinder operation to the single-cylinder operation if the currently required operating frequency of the compressor is less than or equal to the maximum frequency threshold value;

wherein the currently required operating frequency of the compressor is determined based on at least one of: a difference value between a setting temperature value and an ambient temperature value, a setting gear of a fan, or a capacity of an internal machine at the tail end of the unit.

11. The unit according to claim 8, wherein:

the main controller is connected with a first electromagnetic valve and a second electromagnetic valve, respectively, and is further used for controlling the first electromagnetic valve to be powered up and the second electromagnetic valve to be powered down when the compressor is switched from the single-cylinder operation to the double-cylinder operation, so that a variable volume port of the compressor is in a high-pressure state; and controlling the first electromagnetic valve to be powered down and the second electromagnetic valve to be powered up when the compressor is switched from the double-cylinder operation to the single-cylinder operation, so that the variable volume port of the compressor is in a low-pressure state;

wherein the first electromagnetic valve enables an air outlet of the compressor which is in a high-pressure state to be communicated with the variable volume port; and the second electromagnetic valve enables an air suction port of the compressor which is in a low-pressure state to be communicated with the variable volume port.

12. An air conditioning system comprising a unit according to claim 8, wherein the air conditioning system is a variable frequency and a variable capacity air conditioning system.

13. A device for controlling cylinder switching of a compressor, wherein the device performs the method according to claim 1, and the device is configured to:

determine whether the compressor needs to perform cylinder switching;

adjust a current operating frequency according to a system pressure difference if the compressor needs to perform cylinder switching so that both the adjusted operating frequency and the system pressure difference meet a cylinder switching condition of the compressor; and control the compressor to perform cylinder switching.

14. A computer device comprising a processer; and a memory coupled to the processor and storing a plurality of instructions that, when executed by the processor, cause the processor to implement the method for controlling cylinder switching according to claim 1.

15. A non-transitory computer-readable storage medium comprising a plurality of computer executable instructions that, when executed by a processor, cause the processor to perform the method for controlling cylinder switching according to claim 1.

16. A method for controlling cylinder switching of a compressor, comprising:

determining whether the compressor needs to perform cylinder switching;

if so, adjusting current operating frequency according to a system pressure difference so that both the adjusted operating frequency and the system pressure difference meet a cylinder switching condition of the compressor; and controlling the compressor to perform cylinder switching;

the adjusting current operating frequency according to a system pressure difference comprises:

determining target operating frequency according to the system pressure difference; and adjusting the current operating frequency to the target operating frequency;

wherein the determining whether the compressor needs to perform cylinder switching comprises:

determining that the compressor needs to be switched from a double-cylinder operation to a single-cylinder operation; and determining target operating frequency according to the system pressure difference comprises:

if Pc−Pe>d, determining the target operating frequency f=e; or if Pc−Pe≤d, determining the target operation frequency f according to the current operation frequency F;

if Pc−Pe≤d, determining the target operating frequency f according to the current operating frequency F, comprising:

if F>e, determining f=e; or if F<e−p, determining f=e−p; or if F∈[e−p, e], determining f=F;

wherein Pc is a system high pressure, Pe is a system low pressure, Pc−Pe is the system pressure difference, F is the current operating frequency of the compressor, f is the target operating frequency of the compressor, and d, e and p are preset values.

17. The method of claim 16, wherein if it is determined that the compressor needs to be switched from double-cylinder operation to the single-cylinder operation, the cylinder switching condition comprises:

$Pc-Pe \leq d$ and $F \in [e-p, e]$.

18. The method of claim 16, wherein determining whether the compressor needs to perform cylinder switching comprises:

determining that the compressor needs to be switched from the double-cylinder operation to the single-cylinder operation if a currently required operating frequency of the compressor is less than or equal to maximum frequency threshold value which is reachable for the compressor in the single-cylinder operation;

wherein the currently required operating frequency of the compressor is determined based on at least one of: a difference value between a setting temperature value and an ambient temperature value, a setting gear of a fan, or a capacity of an internal machine at the tail end of a unit where the compressor is located.

19. The method of claim 16, wherein the controlling the compressor to perform cylinder switching comprises:

keeping the target operation frequency unchanged in the process of controlling the compressor to perform cylinder switching.

20. An air conditioning unit comprising: a main controller, a compressor and a driving controller of the compressor;

the main controller is used for determining whether the compressor needs to perform cylinder switching; if so, controlling the driving controller to adjust current operating frequency according to a system pressure difference so that both the adjusted operating frequency and the system pressure difference meet a cylinder switching condition of the compressor; and sending a cylinder switching command to the driving controller;

the driving controller is respectively connected with the main controller and the compressor, and is used for controlling the compressor to perform cylinder switching according to the cylinder switching command;

wherein, the adjusting a current operating frequency according to a system pressure difference, comprises:

determining a target operating frequency according to the system pressure difference; and adjusting the current operating frequency to the target operating frequency;

wherein, determining whether the compressor needs to perform cylinder switching comprises:

determining that the compressor needs to be switched from a single-cylinder operation to a double-cylinder operation; and determining the target operating frequency according to the system pressure difference comprises:

if Pc−Pe>d, determining the target operating frequency f=e; or if Pc−Pe≤d, determining the target operation frequency f according to the current operation frequency F;

if Pc−Pe≤d, determining the target operating frequency f according to the current operating frequency F, comprising:

if F>e, determining f=e; or if F<e−p, determining f=e−p; or if F∈[e−p, e], determining f=F;

wherein Pc is a system high pressure, Pe is a system low pressure, Pc−Pe is the system pressure difference, F is the current operating frequency of the compressor, f is the target operating frequency of the compressor, and d, e and p are preset values.

* * * * *